US008469555B2

(12) United States Patent
Rong et al.

(10) Patent No.: US 8,469,555 B2
(45) Date of Patent: Jun. 25, 2013

(54) MULTI-REFLECTOR OPTICAL SYSTEM

(75) Inventors: Wei Rong, Peachtree City, GA (US); Timothy Wright, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 530 days.

(21) Appl. No.: 12/750,434

(22) Filed: Mar. 30, 2010

(65) Prior Publication Data

US 2011/0242822 A1 Oct. 6, 2011

(51) Int. Cl.
*F21V 7/00* (2006.01)

(52) U.S. Cl.
USPC ..... 362/346; 362/350; 313/114

(58) Field of Classification Search
USPC ..... 362/346–350; 313/114
See application file for complete search history.

(56) References Cited

U.S. PATENT DOCUMENTS

| | | | | |
|---|---|---|---|---|
| 1,880,399 | A * | 10/1932 | Benjamin | 362/277 |
| 5,473,523 | A * | 12/1995 | Von Fange | 362/232 |
| 2004/0032739 | A1 * | 2/2004 | Johanson | 362/304 |
| 2009/0135606 | A1 * | 5/2009 | Young | 362/310 |
| 2009/0296367 | A1 * | 12/2009 | Sekine et al. | 362/84 |

* cited by examiner

*Primary Examiner* — Karabi Guharay
(74) *Attorney, Agent, or Firm* — King & Spalding LLP

(57) ABSTRACT

An optical system includes an outer reflector and at least one inner reflector, wherein the inner reflector is disposed within the outer reflector. The outer reflector has a proximal end, a distal end, and an interior surface extending from the distal end to the proximal end. The inner reflector has a proximal end, a distal end, and an interior surface and exterior surface extending from the distal end to the proximal end. The proximal end of the outer reflector is positioned adjacent a light source, wherein the light source is surrounded by the outer reflector's proximal end. The light source emits narrow angle beams of light through the inner reflector and emits wide angle beams of light between the outer reflector's inner surface and the inner reflector's external surface. The positioning and dimension of the inner reflector prevents the light source from emitting wide angle beams of light directly to an illuminated surface.

19 Claims, 3 Drawing Sheets

MULTI-REFLECTOR OPTICAL SYSTEM

TECHNICAL FIELD

The present invention relates generally to optical systems for luminaires. More specifically, the present invention relates to an optical system for light emitting diode ("LED") based lighting systems having two or more reflectors.

BACKGROUND

A luminaire is a system for producing, controlling, and/or distributing light for illumination. For example, a luminaire can include a system that outputs or distributes light into an environment, thereby allowing certain items in that environment to be visible. Luminaires are often referred to as "light fixtures". Conventional luminaries typically use conventional optical systems, including, a total internal reflection ("TIR") lens, a hybrid optical system which includes a refractor and a reflector combination system, and/or a single reflector, for obtaining a desired light distribution. However, at least two issues arise when using conventional optical systems. One is that the lens turns a yellowish color, thereby significantly reducing the efficiency of the light output. The yellowing issue is caused, in large part, because the lens is fabricated from a plastic material, such as a polymethylmethacrylate ("PMMA") or acrylic, or a polycarbonate material, and turns slightly yellow in color when exposed to high temperatures and/or ultraviolet light over time. Yellowing of the lens significantly reduces the efficiency of the light output therethrough because less light is transmitted to an area that is intended to be illuminated.

The useful life of TIR and hybrid lenses can be significantly less than the life of the LED. Selecting a TIR lens material that equals or exceeds the life of the LED can be cost prohibiting for the light fixture market.

In addition, when using a single reflector to obtain the desired light distribution, a halo effect is often created on the area that is to be illuminated. FIG. 1 illustrates a halo effect in a light distribution pattern 100 formed when using a conventional luminaire 150 having a single reflector 170 in accordance with the prior art. Referring to FIG. 1, the conventional luminaire 150 includes the single reflector 170 having a first end 172 and a second end 174 and a light source 160 located adjacent to the first end 172. The first end 172 forms a first opening 173, while the second end 174 forms a second opening 175. The single reflector 170 has a parabolic or conical shape, with the first opening 173 being smaller than the second opening 175. The light source 160 is disposed within the first opening 173 and emits light through the second opening 175 towards an illuminated area 110. Thus, the first end 172 surrounds the light source 160. A portion of the light emitted from the light source 160 is directed towards the internal surface of the reflector 170, reflected, and re-directed to the illuminated area 110 through the second opening 175. This portion of the light creates a hot spot 102 (a small area of increased illumination) on the illuminated area 110. The remaining portion of the light is emitted directly from the light source 160 to the illuminated area 110 through the second opening 175. This remaining portion of the light creates an outer band 104, or outer ring, surrounding the hot spot 102 and at a lumen level below that of the hot spot 102, thereby creating an uneven light distribution on the illuminated area 110. The hot spot 102 and the outer band 104 collectively form the halo light distribution pattern 100.

One solution to correct the halo effect is to cover the second opening 175 with a diffuse lens (not shown). However, adding a diffuse lens increases the cost of the optical system and also reduces light output and light efficiency. Another solution to correct the halo effect is to increase the height of the reflector 170. However, doing so makes the single reflector 170 very tall, which would make using the single reflector 170 within existing light fixtures mechanically unfeasible. Additionally, increasing the height of the reflector 170 increases the amount of material costs.

SUMMARY

One exemplary embodiment of the invention includes an optical system. The optical system can include an outer reflector and at least one inner reflector. At least one inner reflector can be positioned within a cavity formed in the outer reflector such that the outer reflector surrounds at least a portion of the inner reflector. The outer reflector can include an outer reflector proximal end, an outer reflector distal end, and an outer reflector internal surface. The outer reflector internal surface can extend from the outer reflector proximal end to the outer reflector distal end. Each inner reflector can include an inner reflector proximal end, an inner reflector distal end, and an inner reflector internal surface. The inner reflector internal surface can extend from the inner reflector proximal end to the inner reflector distal end.

Another exemplary embodiment of the invention includes an optical system. The optical system can include an outer reflector assembly plate and at least one inner reflector assembly coupled to the outer reflector assembly plate. The outer reflector assembly plate can include one or more outer reflectors arranged in an array. Each outer reflector can include an outer reflector proximal end, an outer reflector distal end, and an outer reflector internal surface. The outer reflector internal surface can extend from the outer reflector proximal end to the outer reflector distal end. Each inner reflector assembly can include one or more inner reflectors. Each inner reflector can include an inner reflector proximal end, an inner reflector distal end, and an inner reflector internal surface. The inner reflector internal surface can extend from the inner reflector proximal end to the inner reflector distal end. At least one inner reflector can be positioned within a corresponding outer reflector.

Another exemplary embodiment of the invention includes a luminaire. The luminaire can include a plurality of light emitting diodes ("LEDs"), an outer reflector, and at least one inner reflector. The outer reflector can include an outer reflector proximal end, an outer reflector distal end, and an outer reflector internal surface. The outer reflector internal surface can extend from the outer reflector proximal end to the outer reflector distal end. Each inner reflector can include an inner reflector proximal end, an inner reflector distal end, and an inner reflector internal surface. The inner reflector internal surface can extend from the inner reflector proximal end to the inner reflector distal end. At least one inner reflector can be positioned within the outer reflector such that the outer reflector surrounds the inner reflector. The LEDs can be positioned adjacent the outer reflector proximal end such that the outer reflector proximal end surrounds the LED.

Another exemplary embodiment of the invention includes a luminaire. The luminaire can include a substrate, a platform, and one or more inner reflector assemblies. The substrate can include an array of LEDs. The platform can include an array of outer reflectors disposed within the platform and a cavity formed within the platform between each pair of outer reflectors. Each outer reflector can include a first opening and a second opening. The first opening can be located at a proximal end of the outer reflector, while the second opening can be located at a distal end of the outer reflector. Each inner reflector assembly can include a base, one or more inner reflectors, and one or more arms extending from the base to the inner reflector. Each inner reflector can include a first opening located at a proximal end of the inner reflector and a second opening located at a distal end of the inner reflector. The base can be coupled to the cavity to position the inner reflector within a respective outer reflector. The proximal end of each outer reflector can rest upon the substrate and receive one or more LEDs within the first opening of the outer reflector.

BRIEF DESCRIPTION OF THE DRAWINGS

The foregoing and other features and aspects of the invention may be best understood with reference to the following description of certain exemplary embodiments, when read in conjunction with the accompanying drawings, wherein.

Figure 1:
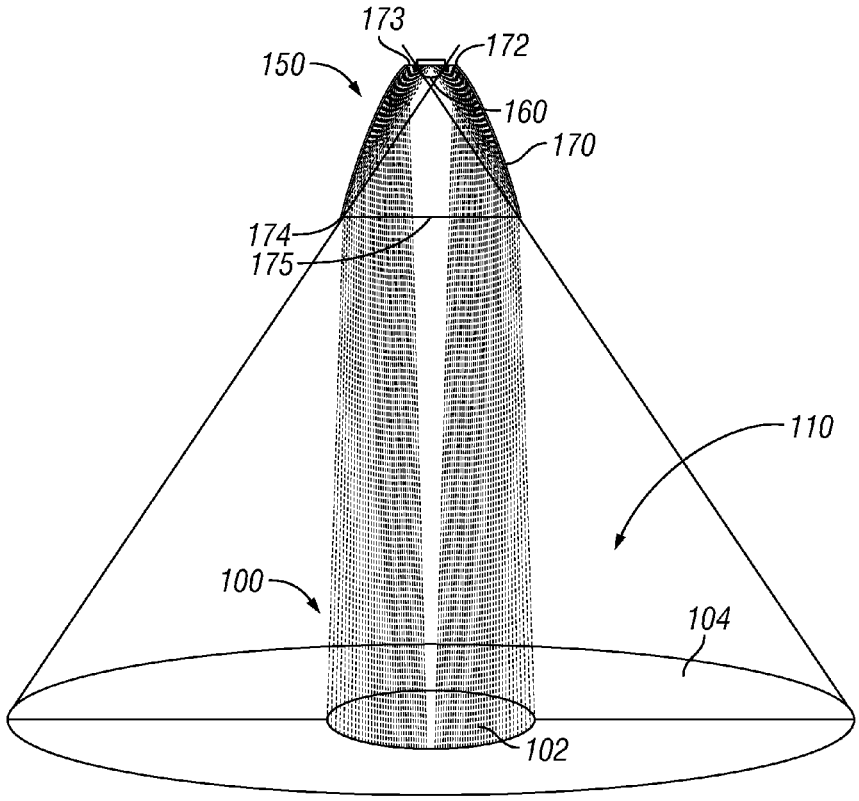
FIG. 1 (Prior Art)
FIG. 1 shows a halo light distribution pattern formed when using a conventional luminaire having a single reflector in accordance with the prior art.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The invention is better understood by reading the following description of non-limiting, exemplary embodiments with reference to the attached drawings, wherein like parts of each of the figures are identified by like reference characters throughout, and which are briefly described below. Although the description of exemplary embodiments is provided below in conjunction with an LED light source, alternate embodiments are applicable to other types of light sources including, but not limited to, high intensity discharge ("HID") lamps, fluorescent lamps, compact fluorescent lamps ("CFLs"), and incandescent lamps. Additionally, the exemplary embodiments described herein are capable of being modified to operate in several different lighting applications including, but not limited to, sign light applications, flood light applications, and internal lighting applications.

Figure 2:
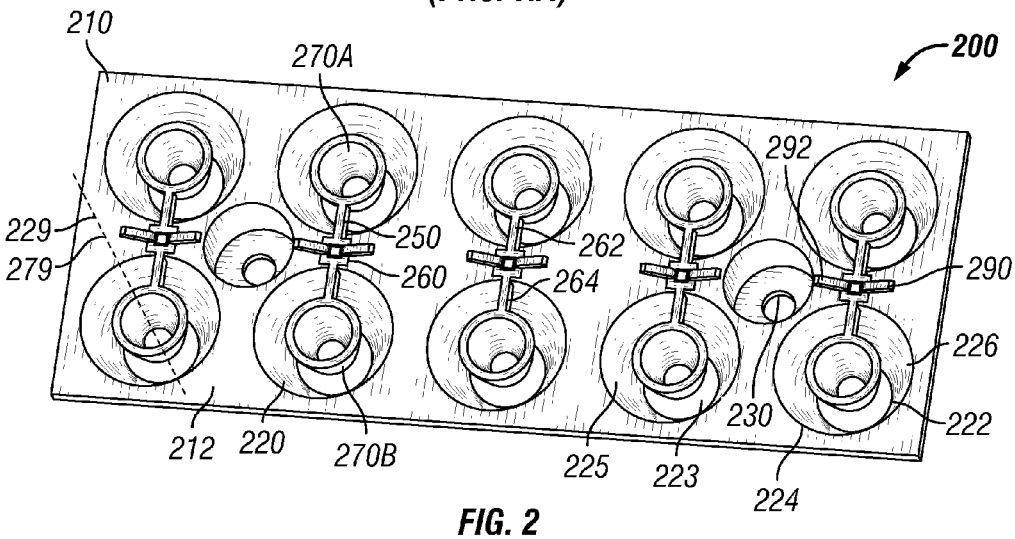
FIG. 2 is a perspective view of a multi-reflector optical system in accordance with an exemplary embodiment of the present invention.
Figure 3:
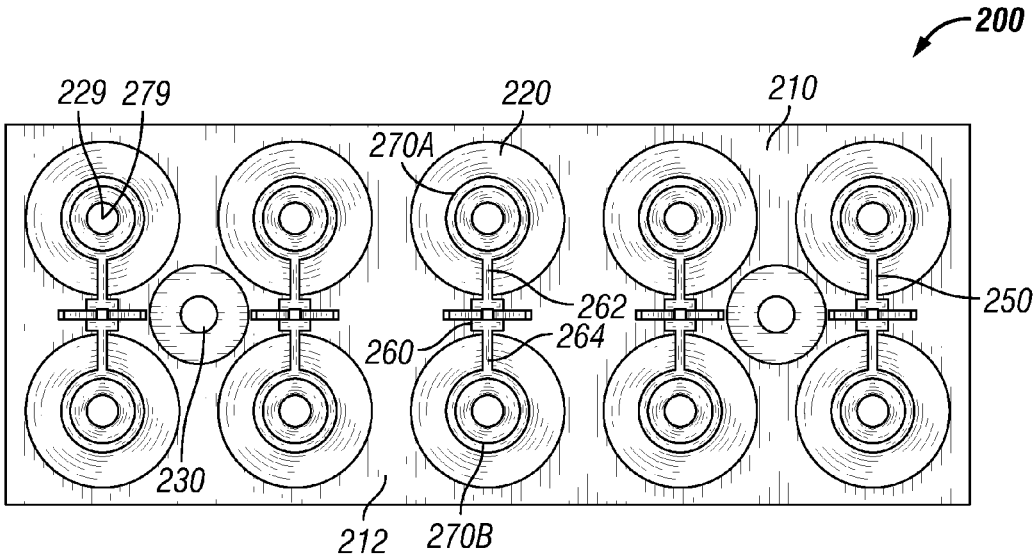
FIG. 3 is a bottom plan view of the multi-reflector optical system of FIG. 2 in accordance with an exemplary embodiment of the present invention.

FIG. 2 is a perspective view of a multi-reflector optical system 200 in accordance with an exemplary embodiment of the present invention. FIG. 3 is a bottom plan view of the exemplary multi-reflector optical system 200 of FIG. 2. Now referring to FIGS. 2 and 3, the multi-reflector optical system 200 includes an outer reflector assembly plate 210 and one or more inner reflector assemblies 250.

Figure 5:
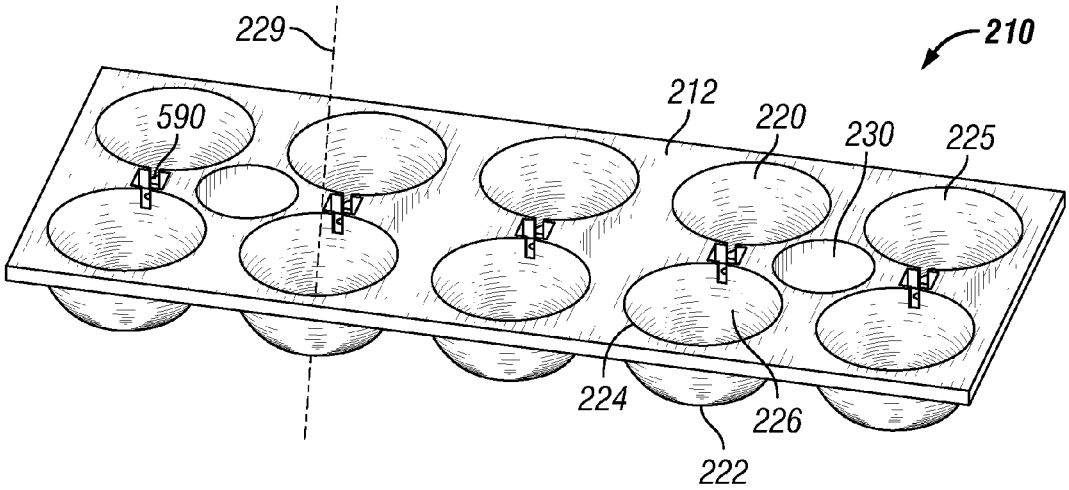
FIG. 5 is a perspective view of an outer reflector assembly plate from the multi-reflector optical system of FIG. 2 in accordance with an exemplary embodiment of the present invention.

FIG. 5 is a perspective view of the outer reflector assembly plate 210 of FIG. 2 in accordance with an exemplary embodiment of the present invention. Referring to FIGS. 2, 3, and 5, the outer reflector assembly plate 210 includes a first surface 212 and one or more outer reflectors 220 extending from the first surface 212 to a distance below the first surface 212. In the exemplary embodiment of FIG. 5, the outer reflectors 220 are arranged in an array within the outer reflector assembly plate 210; however, other reflector arrangements are within the scope and spirit of the present invention. The outer reflector assembly plate 210 has a rectangular shape according to the exemplary embodiment; however, the outer reflector assembly plate 210 is capable of being configured in any geometric or non-geometric shape.

According to one exemplary embodiment, the outer reflector assembly plate 210 includes ten outer reflectors 220 arranged in a two by five rectangular array. However, according to alternate exemplary embodiments, the number of outer reflectors is greater or fewer and arranged in any array shape including, but not limited to, circular, square, triangular, or any other geometric or non-geometric shape without departing from the scope and spirit of the exemplary embodiment. In one exemplary embodiment, each outer reflector 220 is integrally formed into the outer reflector assembly plate 210 as a single piece. However, in alternate exemplary embodiments, at least one outer reflector 220 is separately formed from the outer reflector assembly plate 210 and thereafter coupled to the outer reflector assembly plate 210 using a fastening means (not shown) known to people having ordinary skill in the art including, but not limited to, welding, soldering, snap-fitting, and screwing it on.

Each outer reflector 220 includes an outer reflector proximal end 222, an outer reflector distal end 224, and an outer reflector internal surface 226 extending from the outer reflector proximal end 222 to the outer reflector distal end 224. The outer reflector proximal end 222 is positioned distally from the first surface 212, while the outer reflector distal end 222 is positioned at the first surface 212. The outer reflector proximal end 222 forms an outer reflector proximal opening 223, while the outer reflector distal end 224 forms an outer reflector distal opening 225. In one exemplary embodiment, each of the outer reflector proximal opening 223 and the outer reflector distal opening 225 are circular. Each outer reflector 220 also includes an outer reflector axial axis 229, which includes the centerpoint of the outer reflector proximal opening 223 and the centerpoint of the outer reflector distal opening 225. According to one exemplary embodiment, the diameter of the outer reflector proximal opening 223 is less than the diameter of the outer reflector distal opening 225. However, in alternative embodiments the diameter of the outer reflector proximal opening 223 is equal to or greater than the diameter of the outer reflector distal opening 225. In the exemplary embodiment of FIGS. 2, 3, and 5, the outer reflector internal surface 226 is smooth; however, the surface 226 can be faceted, dimpled, or uneven in alternative exemplary embodiments. According to one exemplary embodiment, the outer reflector 220 has a parabolic shape; however, other shapes, including but not limited to, conical or any other geometric and non-geometric shapes, are within the scope and spirit of the exemplary embodiment.

At least a portion of the outer reflector assembly plate 210 and the outer reflectors 220 are fabricated from plastic material including, but not limited to, PMMA or polycarbonate. At least a portion of the plastic material, including the outer reflector internal surface 226, is coated with a metallic material, such as aluminum or stainless steel, according to processes known to people having ordinary skill in the art, including, but not limited to, vacuum metalizing. Other materials can be used in lieu of or in addition to the plastic material. These materials include, but are not limited to, spun aluminum, turned aluminum, or any other reflective material known to people having ordinary skill in the art.

The outer reflector assembly plate 210 includes one or more attachment openings 230. Fasteners, such as a screws, are positioned through the openings 230 to couple the outer reflector assembly plate 210 to a light assembly (not shown) that includes one or more light sources (not shown), such as an LED. In one exemplary embodiment, which is discussed below in further detail in conjunction with FIG. 4, the light assembly includes a substrate 400 (FIG. 4) with one or more LEDs 410 (FIG. 4) positioned in the same array as the outer reflectors 220. In lieu of or in addition to the attachment opening 230, other attachment means, known to people having ordinary skill in the art, are capable of attaching the outer reflector assembly plate 210 to the light assembly including, but not limited to, epoxy, double-sided heat tape, or an adhesive. In some exemplary embodiments, the outer reflector assembly plate 210 is coupled to the substrate 400 (FIG. 4) and the substrate 400 (FIG. 4) is coupled to the light assembly.

The outer reflector assembly plate 210 also includes one or more recesses 590 positioned adjacent to at least one outer reflector 220 and formed on the first surface 212 of the outer reflector assembly plate 210. The exemplary recess 590 is square-shaped, but is capable of being any geometric or non-geometric shape without departing from the scope and spirit of the exemplary embodiment. The recess 590 receives a portion of the inner reflector assembly 250, which is discussed in further detail below.

Figure 6:
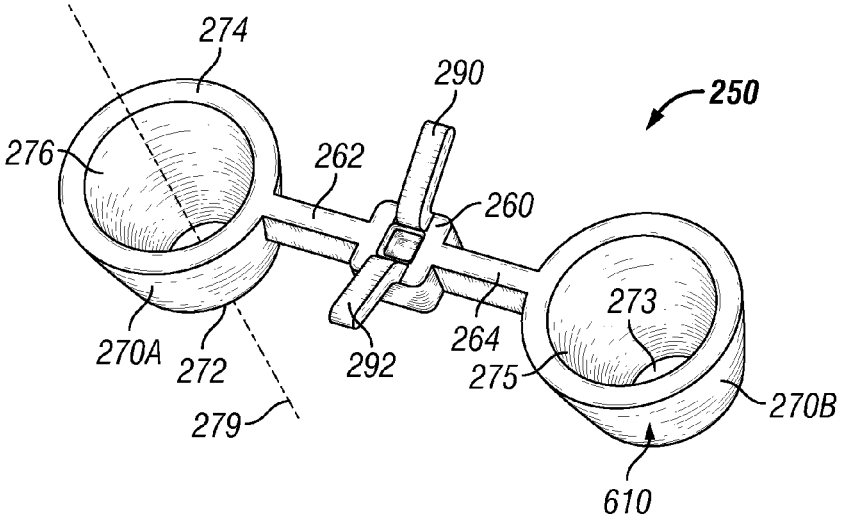
FIG. 6 is a perspective view of an inner reflector assembly from the multi-reflector optical system of FIG. 2 in accordance with an exemplary embodiment of the present invention.

FIG. 6 is a perspective view of the exemplary inner reflector assembly 250 of FIG. 2. Referring to FIGS. 2, 3, and 6, the exemplary inner reflector assembly 250 includes a base 260, a first inner reflector 270A, a first mounting arm 262 having a first end coupled to a portion of the first inner reflector 270A and a second, opposing end coupled to the base 260. The assembly 250 also includes a second inner reflector 270B and a second mounting arm 264 having a first end coupled to the second inner reflector 270B and a second, opposing end coupled to the base 260. In one exemplary embodiment, the inner reflector assembly 250 is integrally formed as a single piece through vacuum molding or other techniques known to people having ordinary skill in the art. Alternatively, the inner reflector assembly 250 is formed from several pieces and coupled to one-another. According to certain exemplary embodiments, the assembly 250 is fabricated from plastic material including, but not limited to, PMMA or polycarbonate. According to certain exemplary embodiments, the assembly 250 is vacuum metalized; however, other materials can be used in lieu of or in addition to the plastic material. These materials include, but are not limited to, spun aluminum, turned aluminum, or any other material known to people having ordinary skill in the art.

The exemplary base 260 is square-shaped and is slidably insertable into the recess 590 (FIG. 5). Although the exemplary base 260 is square, the base 260 is capable of being modified into other geometric or non-geometric shapes so long that the base 260 is complementary in shape to the cavity of the recess 590 (FIG. 5). The base 260 positions the inner reflector 270A and 270B within the corresponding outer reflector 220. In certain exemplary embodiments, the base 260 includes levers 290 and 292 which are cantilevered outward and away from the base 260. Levers 290 and 292 assist the base 260 to be retained within the recess 590 (FIG. 5) once a lens (not shown) is placed over the first surface 212 of the outer reflector assembly plate 210. The lens exerts a force onto the levers 290 and 292, which subsequently maintains the positioning of the base 260 within the cavity of the recess 590 (FIG. 5).

Each inner reflector 270A and 270B includes an inner reflector proximal end 272, an inner reflector distal end 274, an inner reflector internal surface 276 extending from the inner reflector proximal end 272 to the inner reflector distal end 274, and an inner reflector external surface 610 extending from the inner reflector proximal end 272 to the inner reflector distal end 274. The inner reflector proximal end 272 forms an inner reflector proximal opening 273, while the inner reflector distal end 274 forms an inner reflector distal opening 275. Each inner reflector 270A and 270B also includes an inner reflector axial axis 279, which includes the centerpoint of the inner reflector proximal opening 273 and the centerpoint of the inner reflector distal opening 275. In one exemplary embodiment, both the proximal opening 273 and the distal opening 275 are circular; however, other opening shapes are within the scope and spirit of the exemplary embodiment.

According to one exemplary embodiment, the diameter of the inner reflector proximal opening 273 is less than the diameter of the inner reflector distal opening 275. In alternative embodiments, the diameter of the inner reflector proximal opening 273 is equal to or greater than the diameter of the inner reflector distal opening 275. The exemplary inner reflector internal surface 276 is smooth. However, in alternative embodiments, the inner reflector internal surface 276 is faceted, dimpled, or uneven in other exemplary embodiments. Additionally, the exemplary inner reflector external surface 610 is smooth. However, in alternative embodiments, the inner reflector external surface 610 is faceted, dimpled, or uneven in other exemplary embodiments. According to the exemplary embodiment, the shape of the inner reflector 270A and 270B is conical; however other geometric and non-geometric shapes including, but not limited to, parabolic, are within the scope of this disclosure. Although some exemplary embodiments have an inner reflector assembly 250 that has two inner reflectors 270A and 270B coupled together, other exemplary embodiments have an inner reflector assembly that has greater or fewer inner reflectors.

Although bars 262 and 264 are used for coupling the inner reflectors 270A and 270B to the base 260 and for positioning the inner reflectors 270A and 270B within the corresponding outer reflector 220, other devices are capable of positioning the inner reflectors 270A and 270B within the corresponding outer reflector 220. For example, each inner reflector 270A and 270B is capable of being positioned within the corresponding outer reflector 220 using a similar bar that extends from the outer reflector internal surface 226 to the inner reflector 270A and 270B.

Figure 4:
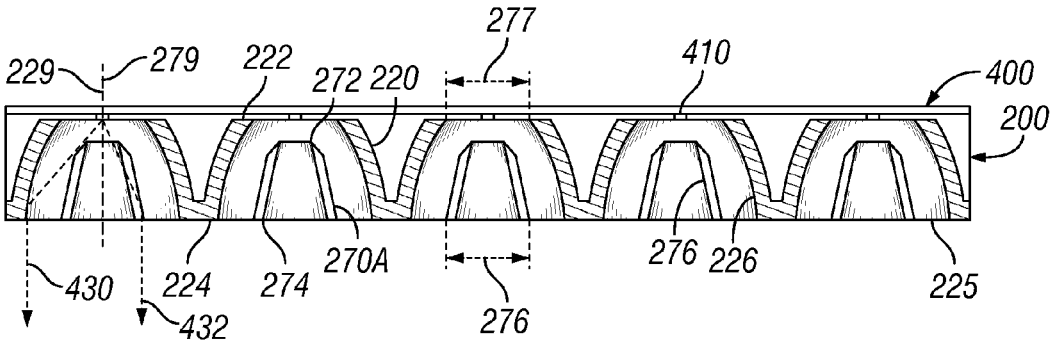
FIG. 4 is a cross-sectional view of the multi-reflector optical system of FIG. 2 disposed over a light source in accordance with an exemplary embodiment of the present invention.

FIG. 4 is a cross-sectional view of the multi-reflector optical system 200 of FIG. 2 disposed over a light source 410 in accordance with an exemplary embodiment of the present invention. Referring to FIGS. 2, 3, and 4, once the base 260 is slidably inserted into and coupled to the recess 590 (FIG. 5), each of the inner reflectors 270A, 270B are positioned within a corresponding outer reflector 220. According to some exemplary embodiments, the inner reflector axial axis 279 and the outer reflector axial axis 229 form the same axis once the inner reflectors 270A, 270B are disposed within the corresponding outer reflector 220. Alternatively, the inner reflector axial axis 279 and the outer reflector axial axis 229 can form a different axis.

In the exemplary embodiment, the light source 410 is positioned substantially on both the inner reflector axial axis 279 and the outer reflector axial axis 229. The light source 410 is position adjacent the outer reflector proximal end 222 such that the outer reflector proximal end 222 is disposed around the light source 410. The light source 410, which in this exemplary embodiment is an LED, is mounted to and electrically coupled to a substrate 400. The substrate 400 is coupled to and in thermal communication with the assembly. In alternative exemplary embodiments where other light sources, such as HID lights, fluorescent lights, CFLs, and incandescent lamps, are used, the substrate 400 is removed and the light source 400 is directly coupled to the assembly by way of a complementary lamp socket. According to this exemplary embodiment, the outer reflector proximal ends 222 are oriented on top of the side of the substrate 400 having the LEDs 410. Further, the outer reflector assembly plate 210 is positioned such that a portion of each respective LED 410 is located substantially in and extends, at least partially, through the center of the outer reflector proximal opening 223.

According to this exemplary embodiment, the substrate 400 includes one or more sheets of ceramic, metal, laminate, circuit board, mylar, or another material. Each LED 410 includes a chip of semi-conductive material that is treated to create a positive-negative ("p-n") junction. When the LED 410 or LED package is electrically coupled to a power source, such as an LED driver (not shown), current flows from the positive side to the negative side of each junction, causing charge carriers to release energy in the form of incoherent light.

The wavelength or color of the emitted light depends on the materials used to make the LED 400 or LED package. For example, a blue or ultraviolet LED typically includes gallium nitride ("GaN") or indium gallium nitride ("InGaN"), a red LED typically includes aluminum gallium arsenide ("AlGaAs"), and a green LED typically includes aluminum gallium phosphide ("AlGaP"). Each of the LEDs 400 in the LED package can produce the same or a distinct color of light. For example, in certain exemplary embodiments, the LED package include one or more white LED's and one or more non-white LEDs, such as red, yellow, amber, or blue LEDs, for adjusting the color temperature output of the light emitted from the luminaire. A yellow or multi-chromatic phosphor may coat or otherwise be used in a blue or ultraviolet LED to create blue and red-shifted light that essentially matches blackbody radiation. The emitted light approximates or emulates "white," incandescent light to a human observer. In certain exemplary embodiments, the emitted light includes substantially white light that seems slightly blue, green, red, yellow, orange, or some other color or tint. In certain exemplary embodiments, the light emitted from the LEDs has a color temperature between 2500 and 5000 degrees Kelvin.

In certain exemplary embodiments, an optically transmissive or clear material (not shown) encapsulates at least a portion of each LED 410 or LED package. This encapsulating material provides environmental protection while transmitting light from the LEDs 410. In certain exemplary embodiments, the encapsulating material includes a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light. In certain exemplary embodiments, the white light has a color temperature between 2500 and 5000 degrees Kelvin.

In certain exemplary embodiments, the LED 410 is an LED package that includes one or more arrays of LEDs 410 that are collectively configured to produce a lumen output from 1 lumen to 5000 lumens. The LEDs 410 or the LED packages are attached to the substrate 400 by one or more solder joints, plugs, epoxy or bonding lines, and/or other means for mounting an electrical/optical device on a surface. The substrate 400 is electrically connected to support circuitry (not shown) and/or the LED driver for supplying electrical power and control to the LEDs 410 or LED packages. For example, one or more wires (not shown) couple opposite ends of the substrate 400 to the LED driver, thereby completing a circuit between the LED driver, substrate 400, and LEDs 410. In certain exemplary embodiments, the LED driver is configured to separately control one or more portions of the LEDs 410 in the array to adjust light color or intensity.

The exemplary inner reflector proximal end 272 is positioned closer to the outer reflector proximal end 222, while the exemplary inner reflector distal end 274 is positioned closer to the outer reflector distal end 224. In one exemplary embodiment, the inner reflector distal end 274 and the outer reflector distal end 224 both lie in the same plane. Furthermore, in this exemplary embodiment, the inner reflector proximal end 272 and the outer reflector proximal end 222 lie in different planes. However, planar alignment for the distal ends 224, 274 are configurable in such a way that the distal ends 224, 274 are not aligned on the same plane. According to one exemplary embodiment, the inner reflector distal opening 275 has diameter 276 that is equal to the diameter 277 of the outer reflector proximal opening 223. Alternatively, the diameters 276, 277 are different.

The light source 410 emits beams of light 430 and 432 through the outer reflector distal opening 225 which proceed to a desired surface to be illuminated (not shown). The beams of light 430 and 432 include narrow angle beams of light 432 which pass through the interior of the inner reflector 270A and wide angle beams of light 430 which pass between the inner reflector exterior surface 610 and the outer reflector interior surface 226. The angles for the narrow beams of light 432 and the wide angle beams of light 430 are variable and dependent upon the dimensions of the outer reflector 220 and the inner reflector 270A and also on the positioning of the inner reflector 270A within the outer reflector 220. The positioning and shape of the inner reflector 270A within the outer reflector 220 prevents any significant amount of wide angle beams of light 430 to exit the outer reflector distal opening 225 without being reflected off the outer reflector internal surface 226. Additionally, according to some exemplary embodiments, the positioning and shape of the inner reflector 270A prevents any significant amounts of wide angle beams of light 430 to exit the outer reflector distal opening 225 and proceed to an area that surrounds the hot spot 102 (FIG. 1), which would thereby create the halo effect. For example, the inner reflector 270A prevents any significant amount of wide angle beams of light 430 to reflect off the outer reflector inner surface 226, proceed to the inner reflector exterior surface 610, reflect off the inner reflector exterior surface 610, and proceed to an area that surrounds the hot spot 102 (FIG. 1). According to some exemplary embodiments, the inner reflector exterior surface 610 is non-reflective to prevent any wide angle beams of light 430 to reach an area that surrounds the hot spot 102 (FIG. 1). According to some exemplary embodiments, the multi-reflector optical system 200 is designed to provide a beam spread angle ranging from about ten degrees to about 120 degrees. According to other exemplary embodiments, the multi-reflector optical system 200 provides a beam spread angle ranging from about ten degrees to about twenty-five degrees. The multi-reflector optical system 200 produces a uniform illumination pattern, wherein the uniform illumination pattern does not include a halo effect.

As previously mentioned, a halo effect is formed when a light source creates a hot spot on the illumination area with a surrounding band at a lower lumen level than that of the lumen level of the hot spot. According to embodiments of this invention, the halo effect is eliminated or minimized because the inner reflector 270A prevents any wide angle beams of light 430 to exit the outer reflector distal opening 225 without being reflected off the outer reflector internal surface 226 and also prevents any significant amounts of wide angle beams of light 430 to exit the outer reflector distal opening 225 and proceed to an illuminated area that surrounds the hot spot. Thus, the surrounding band having a lower lumen level is not formed. The light emitted from the light source 410 is more concentrated within a smaller illumination area. Exemplary embodiments eliminate this halo effect while minimizing the height of the outer reflector 220.

Although some exemplary embodiments have one inner reflector 270A positioned within a corresponding outer reflector 220, some exemplary embodiments have more than one inner reflector 270A positioned within a corresponding outer reflector 220. For example, two or more inner reflectors 270A are positionable within the outer reflector, wherein the inner reflectors are spaced apart horizontally from one another, vertically from one another, or a combination of horizontally and vertically from one another.

Although each exemplary embodiment has been described in detail, it is to be construed that any features and modifications that are applicable to one embodiment are also applicable to the other embodiments. Although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A luminaire, comprising:

a substrate comprising an array of light emitting diodes ("LEDs");

a platform comprising:

an array of outer reflectors disposed within the platform, each outer reflector comprising a first opening at a proximal end of the outer reflector and a second opening at a distal end of the outer reflector; and a cavity formed within a top surface of the platform between the proximal ends of each pair of outer reflectors; and one or more inner reflector assemblies, each inner reflector assembly comprising:

a base;

one or more inner reflectors, each inner reflector comprising a first opening at a proximal end of the inner reflector and a second opening at a distal end of the inner reflector; and one or more arms extending from the base to the inner reflector, wherein the base is coupled within the cavity to position the inner reflector within a respective outer reflector, and wherein the proximal end of each outer reflector rests upon the substrate and receives one or more LEDs within the first opening of the outer reflector.

2. The luminaire of claim 1, wherein the distal end of at least one outer reflector and the distal end of at least one corresponding inner reflector are on a same plane.

3. The luminaire of claim 1, wherein each outer reflector comprises an outer reflector axial axis, wherein each inner reflector comprises an inner reflector axial axis, and wherein at least one inner reflector axial axis is the same as at least one corresponding outer reflector axial axis.

4. The luminaire of claim 3, wherein at least one LED is positioned on the inner reflector axial axis and the outer reflector axial axis.

5. The luminaire of claim 1, wherein the second opening at the distal end of the inner reflector comprises an inner reflector distal diameter, wherein the first opening at the proximal end of the outer reflector comprises an outer reflector proximal diameter, and wherein the inner reflector distal diameter is greater than or equal to the diameter of the outer reflector proximal diameter.

6. The luminaire of claim 1, wherein the inner reflector and the respective outer reflector allow the corresponding one or more LEDs to provide a beam spread angle within a range of about ten degrees to about twenty-five degrees.

7. The luminaire of claim 1, wherein the inner reflector and the respective outer reflector allow the corresponding one or more LEDs to provide a beam spread angle within a range of about ten degrees to about 120 degrees.

8. The luminaire of claim 1, wherein each LED emits one or more wide angle beams of light and one or more narrow angle beams of light, the narrow beams of light proceeding through the interior of the inner reflector and the wide angle beams of light proceeding between the inner reflector and the outer reflector, wherein the outer reflector and the inner reflector prevent the LED from emitting the wide angle beams of light directly to an illuminated surface.

9. The luminaire of claim 8, wherein the inner reflector prevents any wide angle beams of light from directly reaching the circumference of the distal end of the outer reflector.

10. The luminaire of claim 1, wherein each inner reflector further comprises an inner reflector external surface, wherein the inner reflector external surface is non-reflective.

11. A luminaire, comprising:

a substrate comprising an array of light emitting diodes ("LEDs");

a platform comprising:

an array of outer reflectors disposed within the platform, each outer reflector comprising a first opening at a proximal end of the outer reflector and a second opening at a distal end of the outer reflector; and a cavity formed within a top surface of the platform between the proximal ends of each pair of outer reflectors; and one or more inner reflector assemblies, each inner reflector assembly comprising:

a base;

one or more inner reflectors, each inner reflector comprising a first opening at a proximal end of the inner reflector and a second opening at a distal end of the inner reflector; and one or more arms extending from the base to the inner reflector, wherein the base is coupled within the cavity to position the inner reflector within a respective outer reflector, wherein the proximal end of each outer reflector rests upon the substrate and receives one or more LEDs within the first opening of the outer reflector, wherein the distal end of at least one outer reflector and the distal end of at least one corresponding inner reflector are on a same plane, and wherein each outer reflector comprises an outer reflector axial axis, wherein each inner reflector comprises an inner reflector axial axis, and wherein at least one inner reflector axial axis is the same as at least one corresponding outer reflector axial axis.

12. The luminaire of claim 11, wherein the second opening at the distal end of the inner reflector comprises an inner reflector distal diameter, wherein the first opening at the proximal end of the outer reflector comprises an outer reflector proximal diameter, and wherein the inner reflector distal diameter is greater than or equal to the diameter of the outer reflector proximal diameter.

13. The luminaire of claim 11, wherein each LED emits one or more wide angle beams of light and one or more narrow angle beams of light, the narrow beams of light proceeding through the interior of the inner reflector and the wide angle beams of light proceeding between the inner reflector and the outer reflector, wherein the outer reflector and the inner reflector prevent the LED from emitting the wide angle beams of light directly to an illuminated surface.

14. The luminaire of claim 13, wherein the inner reflector prevents any wide angle beams of light from directly reaching the circumference of the distal end of the outer reflector.

15. The luminaire of claim 11, wherein each inner reflector further comprises an inner reflector external surface, wherein the inner reflector external surface is non-reflective.

16. A luminaire, comprising:

a substrate comprising an array of light emitting diodes ("LEDs");

a platform comprising:

an array of outer reflectors disposed within the platform, each outer reflector comprising a first opening at a proximal end of the outer reflector and a second opening at a distal end of the outer reflector; and a cavity formed within a top surface of the platform between the proximal ends of each pair of outer reflectors; and one or more inner reflector assemblies, each inner reflector assembly comprising:

a base;

one or more inner reflectors, each inner reflector comprising a first opening at a proximal end of the inner reflector and a second opening at a distal end of the inner reflector; and one or more arms extending from the base to the inner reflector, wherein the base is coupled within the cavity to position the inner reflector within a respective outer reflector, wherein the proximal end of each outer reflector rests upon the substrate and receives one or more LEDs within the first opening of the outer reflector, wherein each LED emits one or more wide angle beams of light and one or more narrow angle beams of light, the narrow beams of light proceeding through the interior of the inner reflector and the wide angle beams of light proceeding between the inner reflector and the outer reflector, wherein the outer reflector and the inner reflector prevent the LED from emitting the wide angle beams of light directly to an illuminated surface, and wherein each inner reflector further comprises an inner reflector external surface, wherein the inner reflector external surface is non-reflective.

17. The luminaire of claim 16, wherein the inner reflector prevents any wide angle beams of light from directly reaching the circumference of the distal end of the outer reflector.

18. The luminaire of claim 16, wherein the inner reflector and the respective outer reflector allow the corresponding one or more LEDs to provide a beam spread angle within a range of about ten degrees to about twenty-five degrees.

19. The luminaire of claim 16, wherein the inner reflector and the respective outer reflector allow the corresponding one or more LEDs to provide a beam spread angle within a range of about ten degrees to about 120 degrees.

* * * * *